US009557061B2

(12) United States Patent
Biagioli et al.

(10) Patent No.: US 9,557,061 B2
(45) Date of Patent: Jan. 31, 2017

(54) AXIAL SWIRLER

(71) Applicant: ALSTOM Technology Ltd, Baden (CH)

(72) Inventors: Fernando Biagioli, Fislisbach (CH); Madhavan Narasimhan Poyyapakkam, Rotkreuz (CH); Riccardo Cenni, Riolo Terme (IT); Khawar Syed, Oberrohrdorf (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 566 days.

(21) Appl. No.: 14/072,170

(22) Filed: Nov. 5, 2013

(65) Prior Publication Data

US 2014/0123661 A1 May 8, 2014

(30) Foreign Application Priority Data

Nov. 6, 2012 (EP) ..... 12191345

(51) Int. Cl.

| | |
|---|---|
| ***F23R 3/14*** | (2006.01) |
| ***F23R 3/28*** | (2006.01) |
| ***F23C 7/00*** | (2006.01) |
| ***F23R 3/36*** | (2006.01) |

(52) U.S. Cl.

CPC ..... *F23R 3/14* (2013.01); *F23C 7/004* (2013.01); *F23R 3/286* (2013.01); *F23R 3/36* (2013.01); *F23D 2900/14021* (2013.01)

(58) Field of Classification Search

CPC ... F23R 3/14; F23R 3/286; F23D 2900/14021; F23C 7/004; F05D 2240/121; F05D 2240/122; F05D 2260/14

See application file for complete search history.

(56) References Cited

U.S. PATENT DOCUMENTS

| | | | | |
|---|---|---|---|---|
| 6,050,096 | A | 4/2000 | Senior | |
| 2006/0035188 | A1* | 2/2006 | Berenbrink | F23R 3/14 431/285 |
| 2007/0220898 | A1* | 9/2007 | Hessler | F23R 3/286 60/776 |

(Continued)

FOREIGN PATENT DOCUMENTS

| | | |
|---|---|---|
| EP | 0 902 237 | 3/1999 |
| EP | 0 936 406 | 8/1999 |

(Continued)

*Primary Examiner* — Andrew Nguyen

(74) *Attorney, Agent, or Firm* — Buchanan Ingersoll & Rooney PC

(57) ABSTRACT

An axial swirler, in particular for premixing of oxidizer and fuel in gas turbines, includes a series of swirl vanes with a streamline cross-section. Each swirl vane has a leading edge, a trailing edge, and a suction side and a pressure side extending each between the leading and trailing edges. The swirl vanes are arranged around a swirler axis, wherein the leading edges extend essentially in radial direction. Flow slots are formed between the suction side of each swirl vane and the pressure side of its nearest neighboring swirl vane. Furthermore, at least one swirl vane has a discharge flow angle between a tangent to its camber line at its trailing edge and the swirler axis that is monotonically increasing with increasing radial distance from the swirler axis. The invention also relates to a burner with such a swirler and a method of operating the burner.

20 Claims, 3 Drawing Sheets

(56) References Cited

U.S. PATENT DOCUMENTS

| | | | | |
|---|---|---|---|---|
| 2008/0083224 | A1* | 4/2008 | Varatharajan | F23R 3/14 60/748 |
| 2008/0148736 | A1* | 6/2008 | Ishizaka | F23R 3/286 60/737 |
| 2011/0000214 | A1* | 1/2011 | Helmick | F23D 14/76 60/734 |
| 2011/0005232 | A1 | 1/2011 | Williams et al. | |
| 2011/0289933 | A1* | 12/2011 | Boardman | F23R 3/36 60/776 |

FOREIGN PATENT DOCUMENTS

| | | |
|---|---|---|
| EP | 1 394 471 | 3/2004 |
| GB | 2 293 001 | 3/1996 |
| WO | 02/052201 | 7/2002 |

* cited by examiner

AXIAL SWIRLER

CROSS-REFERENCE TO RELATED APPLICATIONS

This application claims priority to European application 12191345.3 filed Nov. 6, 2012, the contents of which are hereby incorporated in its entirety.

TECHNICAL FIELD

The present invention relates to an axial swirler, in particular for premixing purposes in gas turbines, according to the preamble of claim 1, and it relates further to a burner for a combustion chamber with such an axial swirler. In particular it relates to axial swirlers for the introduction of at least one gaseous and/or liquid into a burner. Moreover, it relates to a method of operation of such a burner.

BACKGROUND

Swirlers are used as mixing devices in various technical applications. Optimization of swirlers aims at reducing the energy required to obtain a specified degree of homogeneity of a mixture. In continuous flow mixing the pressure drop over a mixing device is a measure for the required energy. Further, the time and space required to obtain the specified degree of homogeneity are important parameters for the evaluation of mixing devices or mixing elements. Swirlers are typically used for mixing of two or more continuous fluid streams. Axial swirlers are most commonly used as premixers in gas turbine combustors.

A socalled swirl number $s_n$ characterizes the swirl strength of an axial swirler. The swirl number is defined as the ratio between the axial flux of azimuthal momentum and the axial flux of axial momentum multiplied by the swirler radius. The swirl number is an indication of the intensity of swirl in the annular flow induced by the swirler.

With conventional axial swirlers a required recirculation zone is formed only if the swirl number is equal to or larger than about 0.4. The larger is the swirl number, the larger is the pressure drop entailing an unfavorable energy loss.

Conventional Axial swirlers with upstream fuel injection typically produce unfavorable wakes and recirculation regions at the fuel injection location.

Axial swirlers with fuel injection via the swirlers, so-called swozzles, require for good air-fuel mixing swirl numbers that are so high that it is difficult to avoid wakes and flow-separation regions at the fuel injection location and trailing edge.

Dual annular counter-rotating axial swirlers result in a radially varying velocity distribution that is unfavorable for the combustion process for e.g. poor flame holding resistance and combustion dynamics.

SUMMARY

It is an object of the present invention to provide a more effective axial swirler, in particular for premixing of oxidizer, e.g. air, and fuel in gas turbines, with improved mixing characteristics, i.e. producing an increased mixing homogeneity and stability for a given gas pressure drop over the swirler.

A swirler that produces a mixture with a high mixing homogeneity while using only a minimum pressure drop is proposed. Further, a burner with such a swirler is proposed. Such a burner is proposed for example to increase the gas turbine engine efficiency, to increase the fuel capability as well as to simplify the design.

The above and other objects are achieved by an axial swirler, in particular for premixing of oxidizer and fuel in gas turbines, comprising a series or a plurality of swirl vanes with a streamline cross-section, each swirl vane having a leading edge, a trailing edge, and a suction side and a pressure side. The suction side and the pressure side extend each between said leading and trailing edges. The swirl vanes is arranged around a swirler axis, wherein said leading edges extend radially outwardly, essentially in radial direction, and wherein flow slots are formed between the suction side of each swirl vane and the pressure side of its nearest neighboring swirl vane. At least one swirl vane has a discharge flow angle between a tangent to its camber line at its trailing edge and the swirler axis that is monotonically increasing with increasing radial distance from the swirler axis.

It is preferred that all swirl vanes are provided with such a monotonically increasing discharge flow angle.

An increasing discharge flow angle with increasing radial distance from the axis entails increasing swirl with increasing radial distance.

Said discharge flow angle is located at the trailing edge and may be monotonically increasing (i.e. it may be constant over a certain but not the entire range of distance to the swirler axis) or it may be strictly monotonically increasing (i.e. it increases over the entire range; there is no sub-range in which the discharge flow angle remains constant).

A cut through the swirl vane parallel to the swirler axis of the swirler discloses said streamline cross-section.

According to a preferred embodiment, the swirl vane of the axial swirler is formed such that the dependence of the discharge flow angle $\alpha$ on said radial distance R is implicitly given by a function:

$$\tan[\alpha(R)]=K\cdot R^{\beta}+H,$$

wherein $\beta$ is an exponent ranging from 1 to 12, preferably from 1 to 10, more preferably from 3 to 8, and being in particular 7. K and H are constants chosen such i) that the discharge flow angle $\alpha(R_{min})$ at a minimum radial distance $R_{min}$ is ranging from 0 degrees to 25 degrees, preferably from 0 or 5 degrees to 20 degrees; and ii) that the discharge flow angle $\alpha(R_{max})$ at a maximum radial distance $R_{max}$ is ranging from 30 degrees to 60 degrees, preferably 30 degrees to 50 degrees, more preferably 35 degrees to 45 degrees.

The minimum radial distance $R_{min}$ is the distance from the swirler axis to the inner side or the inner lateral surface of the swirl vane. The maximum radial distance $R_{max}$ is the distance from the swirler axis to the outer side or the outer lateral surface of the swirl vane. If the swirl vanes are provided in an annular housing, $R_{min}$ is thus the radius of the cylinder described by the inner limiting wall of the housing, whereas $R_{max}$ is the radius of the cylinder described by the outer limiting wall of the housing. The annulus thus extends in radial direction from $R_{min}$ to $R_{max}$.

This embodiment is thus characterized by an exit or discharge flow angle of which tangent i.e. the hyperbolic function tangent with the angle as argument) increases radially outward proportionally to $R^{\beta}$, with R radius and $\beta$ exponent. K is a multiplicative constant to $R^{\beta}$, H is an additive constant to $R^{\beta}$. Particularly preferred is a value $\beta=7$, wherein the swirler has a swirl number of $s_n=0.4$. H and K may be negative or positive. H may be zero.

In other words, K and H are constants chosen such that a minimum of the discharge flow angle $\alpha$ is ranging from 0 degrees to 25 degrees, preferably from 0 or 5 degrees to 20 degrees and a maximum of the discharge flow angle $\alpha$ is ranging from 30 degrees to 60 degrees, preferably 30 degrees to 50 degrees, more preferably 35 degrees to 45 degrees.

Such a discharge flow angle at the trailing edge allows a 'shearing' radial profile of axial velocity being developed in the gas flow through the swirler, for sufficiently high value of the parameter $\beta$. An increasing twisting of at least the downstream half of the swirl vane further supports the development of such a shearing radial profile.

As a result the swirler as described above may have a very low swirl number close to minimum values necessary to achieve vortex breakdown (here, the swirl number $s_n$ is about 0.4) while achieving the required mixing quality in the mixture. Consequently, operating at lower pressure drops, higher flashback margin, improved flame stability and lower NOx-emissions are possible. The swirler allows a rapid mixing. This concept alleviates several of well-known issues in the $1^{st}$ stage combustor or premixed combustor. Fuel-air mixing is further improvable by using sufficiently high values of the exponent $\beta$ (which reduces the swirl number and increases the velocity shearing) and by injecting fuel through one side, preferably through both sides of the swirl vane(s). The swirler according to invention offers clean aerodynamics and enhanced mixing characteristics that are desirable for premixed combustion.

The swirler proposed here allows injecting fuel on both sides of the swirl vane or blade (i.e. its pressure and suction side). This helps in achieving optimal fuel-air premixing in several ways:

- The exponentially increasing exit flow angle produces shearing in the axial velocity, which enhances turbulence and mixing.
- Two-side fuel injection fills the fuel in the entire cross-section of the swirler exit.
- The increase in $\beta$ allows for a reduction of the swirl number (cf. FIG. 5) and the pressure losses (cf. FIG. 6).

With optimal choice of the parameter $\beta \approx 7$ in vicinity of the minimum swirl number 0.4 for vortex breakdown (cf. FIG. 6), the suggested design modification results in choosing a reduced swirl number of the axial swirler, thereby reducing the pressure drop requirements for the premixer. The savings in pressure drop can result in targeting higher efficiency or make it available for other useful purposes.

In addition the axial swirler is advantageous as:

- it improves premixing of fuel with air;
- the reduced pressure drop allows for a more compact burner design, higher bulk velocities, and results in improved flashback resistance.

The length and swirl angle of the axial swirler is also controlled in relation to the overall mixer performance. The lower swirl angle helps in reducing the flow gradients due to the suction/pressure sides of the swirler.

For a fixed value of the burner pressure drop, the present design allows for more compact size with improvements in NOx-emissions.

An axial swirler with a discharge or exit flow angle given by tan-formula as described above allows a 'shearing' radial profile of axial velocity for sufficiently high value of the parameter $\beta$. Also, it allows reduction of pressure drop for high values of the parameter $\beta$ without losing efficiency in fuel-air premixing.

Typically, between 4 and 20 vanes are used per axial swirler. In one embodiment between 5 to 15 vanes, e.g. 7, 8, or 10 vanes are used per swirler. To avoid unfavorable resonance phenomena due to excitation of Eigen frequencies in the flow downstream of the vanes, having an odd number of vanes is preferred.

According to a preferred embodiment the leading edge of the swirl vane is an essentially straight edge preferably extending in radial direction and/or the camber line of the swirl vane is curved to form a C-shape or an S-shape.

It is preferred that the trailing edge is curved or straight. Preferably, the trailing edge is twisted or rotated with respect to the leading edge, preferably such that the trailing edge extends with increasing distance from the swirl axis increasingly in the direction in that the pressure side of the swirl vane faces. The angle of twisting or rotation may be 0 to 45 degrees or 50 degrees, preferably 5 degrees to 35 degrees, more preferably 10 degrees to 20 degrees or 25 degrees.

Preferably, said curvature of the trailing edge is concave with respect to the suction side.

Further, it is preferred that the swirl vanes are arranged around the swirler axis essentially in a circle.

Preferably, the swirler is provided with an annular housing with an outer limiting wall and an inner limiting wall, wherein the swirl vanes extend along the axis of the swirler and from the inner limiting wall through the annulus to the outer limiting wall. The cross-sectional shape of the inner tube of the annular housing, i.e. the inner limiting wall, defines on how the swirl vanes are arranged with respect to one another. Preferably, the inner tube has a round or circular cross-sectional shape.

According to one embodiment the housing is extending with a central axis aligned with them main-flow direction. The resulting swirler has inlet area and an outlet area, which are normal to the central axis to form an axial swirler.

In yet another preferred embodiment the leading edge and/or the trailing edge extend radially in a plane perpendicular to the swirler axis.

It is preferred that all the swirl vanes of the swirler are identically shaped or structured. This minimized production costs and simplifies the design and the assembling of the device.

If applied to a burner, the swirler as described above leads to a good mixing at low pressure drop but also to a high recirculation flow in a subsequent combustor. A high recirculation flow leads to a better, more stable combustion. Typically the flame stability improves with the recirculation flow, i.e. combustion pulsations can be avoided or reduced with increasing recirculation flow $r_r$ in a combustion chamber, where $r_r$ is defined as the ratio of recirculated flow to swirl flow. However, to achieve a high relative recirculation flow $r_r$, a high swirl number $s_n$ is required, where $s_n$ is defined as the ratio of swirl flow to total mass flow through the burner. Since a swirl flow can only be imposed with a pressure drop, the swirl number $s_n$ should be kept low for an optimized performance, i.e. power and efficiency of the gas turbine.

The burner comprising an axial swirler as described above is characterized in that at least one of the swirl vanes is configured as an injection device with at least one fuel nozzle for introducing at least one fuel into the burner.

The burner can comprise one swirler or a plurality of swirlers. A burner with one swirler typically has a circular cross section. A burner comprising a plurality of swirlers can have any cross-section but is typically circular or rectangular. Typically a plurality of burners is arranged coaxially around the axis of a gas turbine. The burner cross-section is defined by a limiting wall, which for example forms a can-like burner.

In a preferred embodiment the burner under full load injects fuel from the suction side or the pressure side of at least one, preferable of all swirl vanes. Under partial load the fuel injection may be staged as described below.

In a particularly preferred embodiment, the fuel is injected on the suction side and the pressure side of each swirler vane, i.e. from both sides of the injecting swirl vane simultaneously. This allows for a design with a low critical swirl number and reduced pressure drop. The injection from the pressure side is driven by the flow toward the minimum radius, i.e. toward the swirl axis, thereby filling the radially inner part of the annulus of the annular housing, while injection from the suction side is driven radially outward, thereby filling the radially outer part of the annulus. This is a consequence of the discharge flow angle according to invention and may be enhanced by having the trailing edge running with increasing distance from the axis, i.e. radially outwardly, increasingly in the direction in that the pressure side faces. The critical swirl number $s_n$ for this design can be much lower than the standard designs to fill the radially inner and outer regions.

Preferably, each flow slot, being created between circumferentially adjacent swirl vanes of the series or plurality of swirl vanes, has a gas entrance region that extends downstream-from the leading edges (typically along the upstream third or upstream half of the swirl vane) and a gas discharge region that extends upstream from the trailing edges of its defining swirl vanes (typically along the downstream stream third or downstream half of the swirl vane), wherein the fuel is injected into the flow slot in the gas entrance region, preferably in the (first) upstream third of the swirl vane (i.e. close to the leading edge) and/or preferably in a cross-flow injection. According to one embodiment a plurality of fuel nozzles is distributed in said upstream third of the length of the swirl vane measured along the swirl axis, more preferably only in the upstream quarter of said length.

It is preferred that the fuel is injected by a series of fuel nozzles, e.g. 4 to 12, preferably 6 nozzles, being preferably arranged one adjacent another in radial direction along the vane surface or essentially parallel to the leading edge, wherein the fuel nozzles are circular and/or are elongated slot nozzles extending essentially parallel to the leading edge of the swirl vane and/or comprise a first nozzle for injection of liquid fuel, and/or a second nozzle for injection of a gaseous fuel and a third nozzle for injection of carrier air, which encloses the first nozzle and/or the second nozzle.

This carrier air then also serves for cooling purposes of the fuel, thereby effectively avoiding flashback problems.

According to a preferred embodiment, the swirl vane is provided with cooling elements, for introduction of cooling air through the axial swirler in particular to avoid flashback. Preferably these cooling elements are given by internal circulation of cooling medium along the sidewalls of the vane body (i.e. by providing the vanes with a double wall structure) and/or by film cooling holes, preferably located near the leading or trailing edge, and wherein most preferably the cooling elements are fed with air from the carrier gas feed also used for the fuel injection. A plurality of separate outlet orifices or a plurality of nozzles can be arranged next to one another for introduction of cooling air. Cooling air may be introduced through the suction and/or the pressure side of a part of or of all swirl vanes.

The burner can be used for fuel-air mixing as well as mixing of fuel or gas with any kind of gas used in closed or semi-closed gas turbines or with combustion gases of a first combustion stage. The burner can be used for gas turbines comprising one compressor, one combustor and one turbine as well as for gas turbines with one or multiple compressors, at least two combustors and at least two turbines. They can for example be used as premix burners in a gas turbine with one combustor or also be used in a reheat combustor for a secondary combustion chamber of a gas turbine with sequential combustion having a first and a second combustion chamber, with an injection device for the introduction of at least one gaseous and/or liquid fuel into the burner.

Besides an improved burner comprising the swirler, a method for operation of such a burner is an objective of the invention. Depending on the operating condition and load point of a gas turbine, the fuel-flow injected through a burner varies in a wide range. A simple operation where the flow is equally distributed to all burner nozzles and the flow through each nozzle is proportional to the total flow can lead to undesirably small flow velocities at individual nozzles, impairing the injection quality and penetration depth of the fuel into the air flow.

It is preferred that the fuel injection is staged below a threshold fuel flow, e.g. if the turbine is performing at partial load, such that the fuel is in one embodiment injected only on the suction side or the pressure side and/or only through every second or third fuel nozzle of a swirl vane and/or that fuel is only injected through the fuel nozzles of every second or third vane of the burner.

Further, the combination of both methods to reduce fuel injection is suggested: For low fuel mass flows the fuel is injected through every second or third fuel nozzle of a vane and only through the fuel nozzles of every second or third vane of the burner is proposed. At an increased mass flow the number of vanes used for fuel injection and then the number of nozzles used for fuel injection per vane can be increased.

The staging between the suction and pressure sides and/or different nozzles allows further optimization of the premixing and control of the combustion dynamics. Fuel staging allows controlling emissions and pulsations.

In another embodiment, different fuel may be injected through the suction sides and through pressure sides and/or through different nozzles of the swirl vanes.

According to one embodiment of the operating method, the number of fuel injection nozzles through which fuel is injected is determined as function of the total injected fuel flow in order to assure a minimum flow in the operative nozzles.

Alternatively, at an increased mass flow the number of nozzles used for fuel injection per vane can be increased and then the number of vanes used for fuel injection and can be increased. Activation and deactivation of nozzles can for example be determined based on corresponding threshold fuel flows.

Typically, at least the nozzle injects fuel (liquid or gas) and/or carrier gas essentially perpendicular to the main flow direction (cross-flow injection). At least one nozzle may, however, also inject fuel and/or carrier gas at an inclination angle.

Preferably, the vane extends across the entire flow cross section between opposite walls of the burner. Preferably, the fuel nozzles are distributed over the whole width of the swirl vane (i.e. from inner to outer limiting wall).

At least one slit-shaped outlet orifice can be, in the sense of a nozzle, arranged at the trailing edge. A split-shaped or elongated slot nozzle is typically arranged to extend along the trailing edge of the vane.

The nozzles can comprise multiple outlet orifices for different fuel types and carrier air. In one embodiment a first nozzle for injection of liquid fuel or gas fuel, and a second nozzle for injection of carrier air, which encloses the first nozzle, are arranged at the trailing edge.

In another embodiment a first nozzle for injection of liquid fuel, a second nozzle for injection of a gaseous fuel, which encloses the first nozzle, and a third nozzle for injection of carrier air, which encloses the first nozzle, and the second nozzle, are arranged at the trailing edge.

Moreover, it is preferred that the fuel is a highly reactive fuel, preferably chosen from the group consisting of natural gas fuels, hydrogen rich fuels, and hydrogen fuel.

Furthermore the present invention relates to the use of a burner as defined above for the combustion under high reactivity conditions, preferably for the combustion at high burner inlet temperatures and/or for the combustion of MBtu fuel, normally with a calorific value of 5,000-20,000 kJ/kg, preferably 7,000-17,000 kJ/kg, more preferably 10,000-15,000 kJ/kg, most preferably such a fuel comprising hydrogen gas.

Preferably the axial swirler and/or the burner described above is used in an annular combustor, a can combustors, or a single or reheat engines.

Further embodiments of the invention are laid down in the dependent claims.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DESCRIPTION OF PREFERRED EMBODIMENTS

Figure 1:
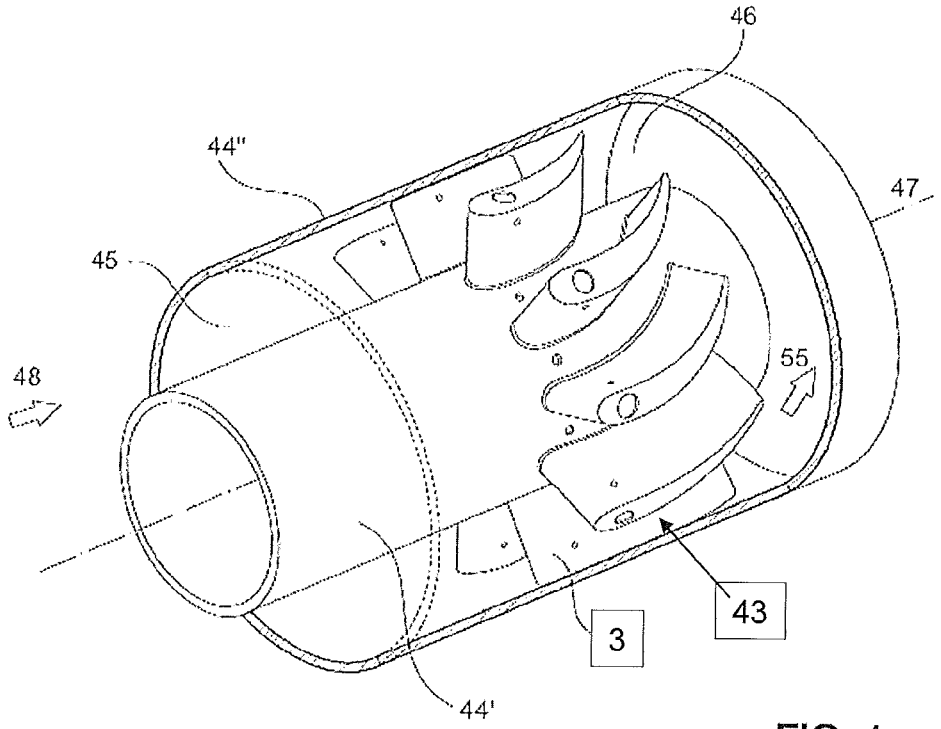
FIG. 1 shows a schematic perspective view onto a conventional swirler with swirl vanes having trailing edges with conventional discharge flow angles $\alpha(R)$=const.

FIG. 1 shows FIG. 1 shows a schematic perspective view onto a conventional swirler 43. The swirler 43 comprises an annular housing with an inner limiting wall 44', an outer limiting wall 44", an inlet area 45, and an outlet area 46. Vanes 3 are arranged between the inner limiting wall 44' and outer limiting wall 44". The swirl vanes 3 are provided with a discharge flow angle that does not depend on a distance R from a swirl axis 47, but is constant throughout the annulus. The leading edge area of each vane 3 has a profile, which is oriented parallel to the inlet flow direction 48. In the example shown the inflow is coaxial to the longitudinal axis 47 of the swirler 43. The profiles of the vanes 3 turn from the main flow direction 48 to impose a swirl on the flow, and resulting in an outlet-flow direction 55, which has an angle relative to the inlet flow direction 48. The main flow is coaxial to the annular swirler. The outlet flow is rotating around the axis 47 of the swirler 43. The present invention improves the swirl vanes 3 by providing them with a discharge flow angle that varies with distance R.

Figure 2:
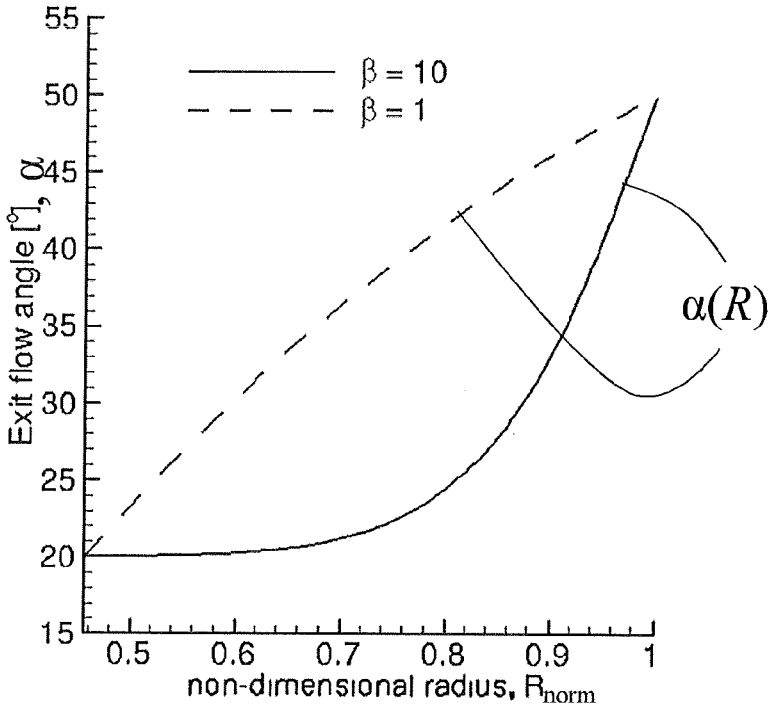
FIG. 2 shows two exemplary dependences $\alpha(R)$ of a discharge flow angle $\alpha$ on a distance R to the swirler axis of an axial swirler according to function: $\tan[\alpha(R)]=K\cdot R^{\beta}+H$.

FIG. 2 shows two examples of dependences of the discharge or exit flow angle $\alpha$ on the radial distance R to the swirler axis 47, wherein the dependences are implicitly defined by the function:

$$\tan[\alpha(R)]=K\cdot R^{\beta}+H.$$

The dashed line is for an exponent value $\beta=1$ and the solid line for an exponent value $\beta=10$. $R_{norm}$ is defined as $R_{norm}$ [dimensionless]=R [in meters]/$R_{max}$ [in meters]; $R_{norm}$ is normalized with the maximum value $R_{max}$ of the distance R to the swirler axis 47 value, hence dimensionless.

For $\beta=1$: K has a value of about 1.5. H has a value of about −0.33.

For $\beta=10$: K has a value of about 0.8. H has a value of about 0.36.

Figure 3:
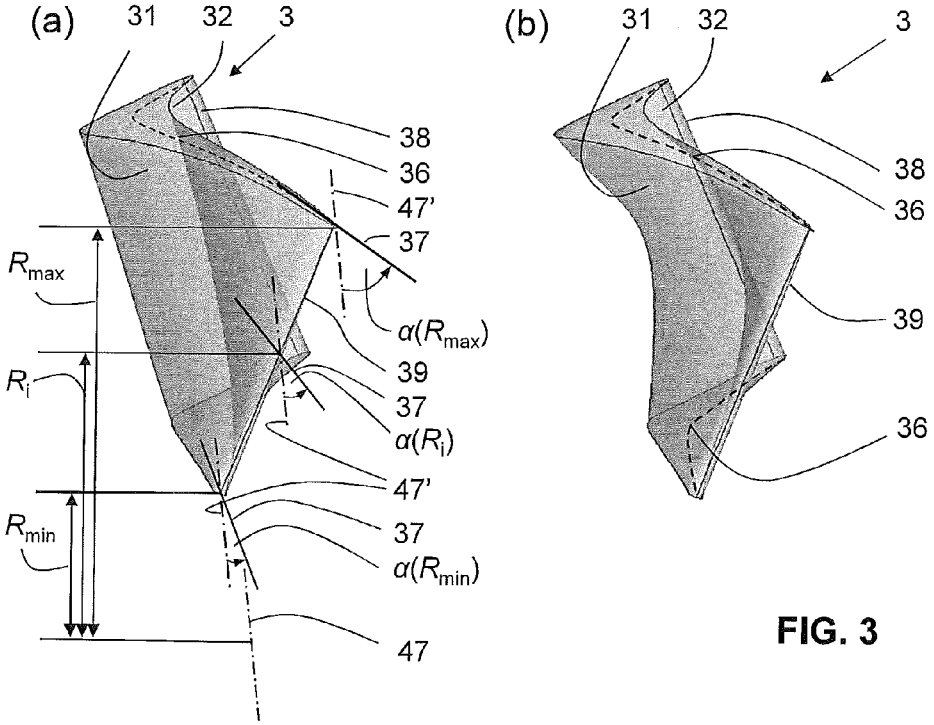
FIG. 3 shows two exemplary swirl blades or vanes according to invention with respective R-dependences with exponent $\beta=1$ and $\beta=10$ according to FIG. 2 and function $\tan[\alpha(R)]=K\cdot R^{\beta}+H$.

FIG. 3 shows two embodiments of the swirler blade 3 that both satisfy the above mentioned function of FIG. 2 with $\beta=1$ (FIG. 3(*a*)) and $\beta=10$ (FIG. 3(*b*)).

The swirler vanes 3 shown in FIG. 3 extend from a leading edge 38 to a trailing edge 39. The leading edge area of each vane 3 has a profile, which is oriented essentially parallel to the inflow. The inflow is coaxial to the longitudinal axis 47 of the swirler 43. The profiles of the vanes 3 turn from the main flow direction 48, i.e. in downstream direction the streamline profile twists and bends such as to form a smoothly shaped suction side 31 and pressure side 32. This shape imposes a swirl on the flow and results in an outlet-flow direction, which has an angle relative to the inlet flow direction 48. The main flow is coaxial to the annular swirler. The outlet flow is rotating around the axis 47 of the swirler 43.

In the embodiment of vanes according to FIG. 3, both edges 38, 39 are each essentially straight and each arranged in a plane normal to axis 47. The trailing edge 39 is, with respect to the leading edge 38, vertically shifted in FIG. 3 (out of the drawing layer, i.e. trailing edge 39 lies above leading edge 38). As depicted in FIG. 3, the trailing edge 38 is also horizontally shifted (to the left in the drawing layer). Furthermore, the trailing edge 39 is rotated clockwise by about 20 degrees with respect to the leading edge 38.

The suction side 31 (facing to the left in FIG. 3) and the pressure side 32 (facing to the right in FIG. 3) extend from the leading edge 38 downstream to the trailing edge 39. The surface progression of sides 31 and 32 is smooth. The suction side 31 is essentially concavely shaped in the direction of the axis 47 and the pressure side 32 is essentially convexly shaped in the direction of the axis 47. In the direction of the leading edge 38, the suction side 31 of vane 3 according to FIG. 3(*a*) is essentially flat or slightly concavely shaped and the suction side 31 of vane 3 according to FIG. 3(*b*) is concavely shaped, whereas the pressure side 32 of vane 3 according to FIG. 3(*a*) is essentially flat or slightly convexly shaped and the pressure side 32 of vane 3 according to FIG. 3(*b*) is essentially convexly shaped. The trailing edge 39 is essentially straight and rotated, i.e. it runs, with increasing R, in the direction in which the pressure side 32 faces. The discharge flow angle α increases with increasing distance R.

The vanes 3 in FIG. 3 cause the gas flow on the pressure side 32 to be driven toward the minimum radius $R_{min}$, thereby filling the inner part of the annulus, while the gas flow on suction side 31 is driven radially outwardly toward the maximum radius $R_{max}$, thereby filling the outer part of the annulus.

At the trailing edge 39 of FIG. 3(*a*) three positions, i.e. three values for the radial distance R are indicated, namely for a minimum value $R_{min}$, an intermediate value $R_i$, and a maximum value $R_{max}$.

At all three positions a parallel line 47' to the swirl axis 47 is indicated as a dashed-dotted line. Furthermore, a camber line 36 (see dashed line in FIG. 3), given by a cut of a center surface between surfaces 31, 32 of vane 3 and cross-sectional plane, is indicated as solid line at positions $R_{min}$, $R_i$, $R_{max}$. The corresponding α-values are indicated as $\alpha(R_{min})$, $\alpha(R_i)$, $\alpha(R_{max})$. It is apparent, that α is increasing with increasing R.

Figure 4:
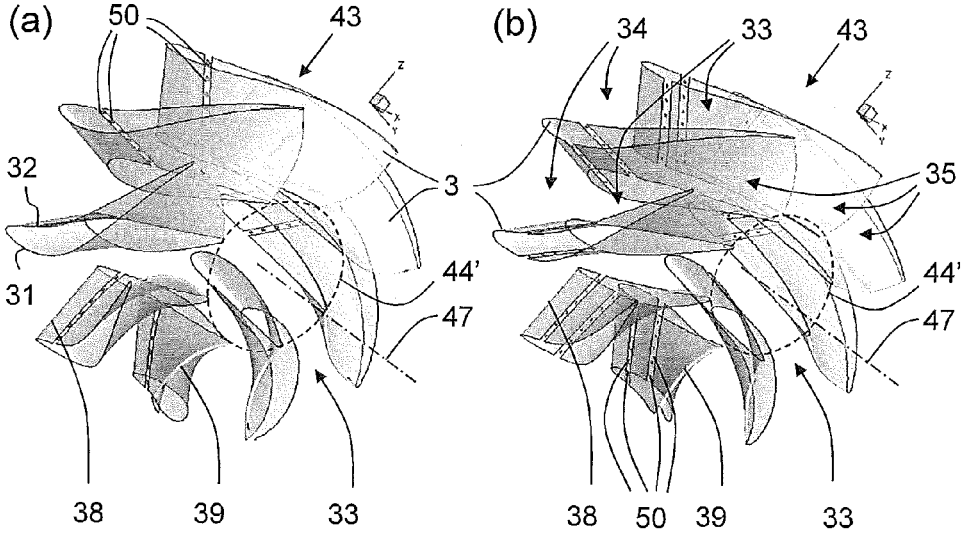
FIG. 4 shows a schematic perspective view of swirl vanes as arranged in an axial swirler configuration with $\beta=1$, wherein (a) shows a configuration of swirl vanes causing high swirl (high swirl number $s_n$) and (b) shows a configuration of swirl vanes causing a low swirl (low swirl number $s_n$)

FIG. 4 shows in each subfigure (a) and (b) a schematic perspective view of the swirl vanes 3 as arranged in the axial swirler 43. The annular housing around swirler axis 47, with limiting walls 44, 44", inlet 45, and outlet 46 are not shown. The inner limiting wall 44' of the housing is indicated by a dashed circle. In FIG. 4, the R-dependence of the discharge flow angle α is following the above mentioned tan-function with β=1. Eight swirl vanes 3 are shown. Between the swirl vanes 3, i.e. between a convex pressure side 32 of one vane 3 and a concave suction side 31 of a circumferentially adjacent vane 3, flow slots 33 with a gas entrance region 34 in the upstream third near the leading edge 38 and a gas discharge region 35 in the downstream third near the trailing edge 39 are formed. Each swirl vane 3 has a straight leading edge 38 and a curved trailing edge 39. The trailing edge 39 is convexly curved with respect to the suction side 31. Such curved trailing edge allows achievement of the desired radial distribution of □(R) without moving the position of maximum camber too close to the extreme positions (leading and trailing edges), i.e. within 30% distance from the leading edge and 20% distance from the trailing edge.

In FIG. 4(*a*) a high swirl configuration, i.e. a swirler with a low swirl number $s_n$ of 0.7 is shown, whereas in FIG. 4(*b*) a swirler with a lower swirl, i.e. with a lower swirl number than the embodiment in FIG. 4(*a*) is shown ($s_n$ of about 0.5 to 0.6). In other words, the vanes 3 of the embodiment of FIG. 4(*a*) are more twisted than the vanes 3 of the embodiment of FIG. 4(*b*).

In FIG. 4(*a*) fuel nozzles 50 are shown, which are arranged on the pressure side 32 of each vane 3. The six fuel nozzles 50 of one vane 3 are arranged in an essentially straight or straight line, essentially parallel or parallel to the leading edge 38, in the upstream third of the vane 3, i.e. in the gas entrance region 34.

In FIG. 4(*b*) the fuel nozzles 50 are arranged on the pressure side 32 as described above and, additionally, the suction side 31 is provided with nozzles 50. The fuel nozzles 50 on the suction side 31 are also arranged in the gas entrance region 34, such that one fuel nozzle 50 from the suction side 31 is opposite one nozzle 50 on the pressure side 32 of the same vane 3.

Fuel injection through fuel nozzles 50 on both sides 31, 32 leads to a higher mixing quality, as fuel injected from pressure side 32 is driven by the flow toward the minimum radius $R_{min}$, thereby filling the inner part of the annulus, while fuel injected from the suction side 31 is driven radially outwardly toward $R_{max}$, thereby filling the outer part of the annulus. The unmixedness of the fuel-air mixture after premixing with swirler 43 is decreased by a factor of about 10 when changing from one-side fuel injection to two-side fuel injection.

Unmixedness represents a measure of fuel/air premixing at molecular level in a turbulent flow. The definition is such that unmixedness is zero (U=0) for fully molecularly premixed condition and one (U=1) for molecularly segregated conditions.

Figure 5:
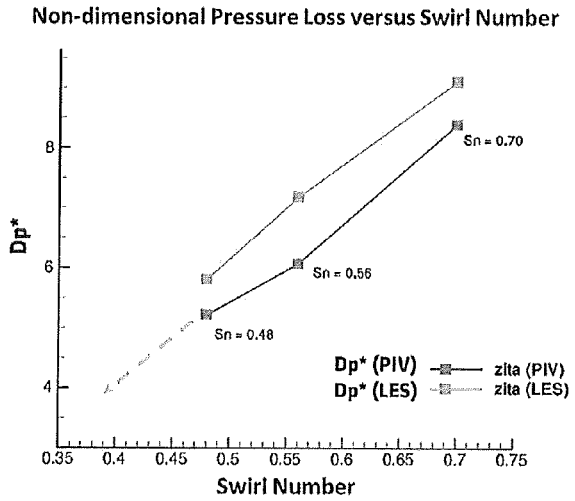
FIG. 5 shows the nondimensional pressure loss over the swirler scaling with the swirl number of the swirler as from experiments and CFD calculations.

FIG. 5 shows the (non-dimensional) pressure drop Dp* with as a function of the swirl number $S_n$ from experiments and CFD calculations. It clearly shows that the pressure drop Dp* decreases for smaller swirl numbers $s_n$.

Figure 6:
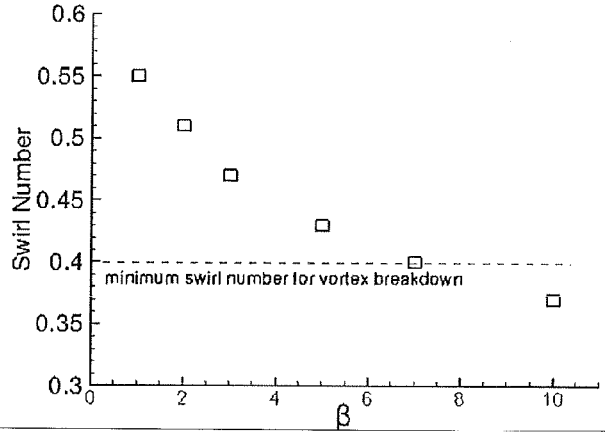
FIG. 6 shows the dependence of the swirl number $s_n$ on the exponent $\beta$ as given by function: $\tan[\alpha(R)]=K\cdot R^{\beta}+H$ with minimum discharge flow angle $\alpha(R_{min})=20$ degrees and maximum discharge flow angle $\alpha(R_{max})=50$ degrees.

FIG. 6 shows the dependence of the swirl number $s_n$ on the parameter β for $\alpha(R_{min})$=20 degrees and $\alpha(R_{max})$=50 degrees. It is apparent that a β-value of about 7 may be chosen to reach the minimum swirl number of about 0.4 for vortex breakdown. I.e. with β≈7 vortex breakdown is achieved with sn≈0.4.

The swirl number is can be obtained by:

$$s_n = \frac{\int_{R_{MIN}}^{R_{MAX}} U\,W\,R^2\,dR}{R_{MAX}\int_{R_{MIN}}^{R_{MAX}} U^2\,R\,dR}$$

with the radius of the swirler R, the axial component of the velocity U and tangential components of velocity W at radius.

Figure 7:
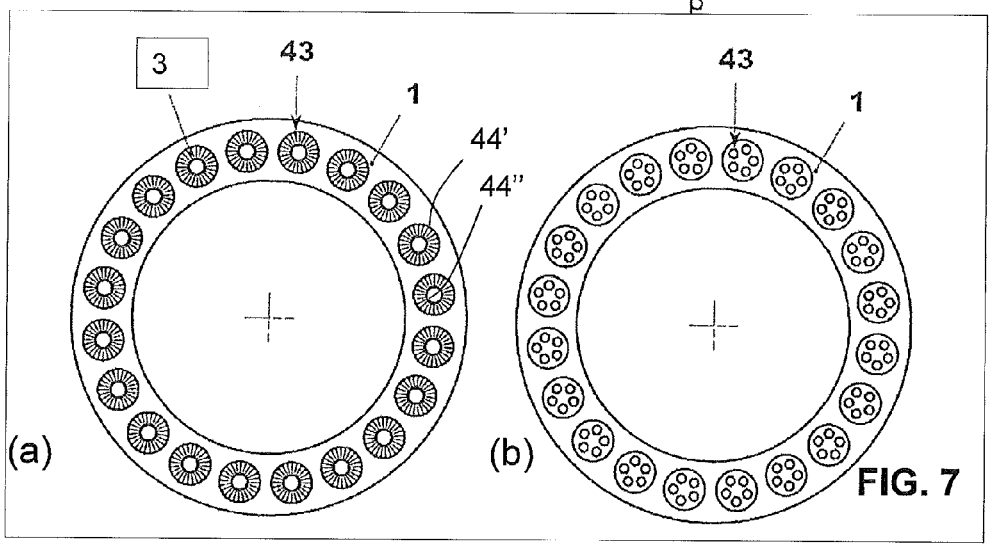
FIG. 7 shows in (a) an example of an annular combustor with burners comprising one swirler per burner as well as in (b) an example of an annular combustor with a burner comprising five swirlers per burner.

FIG. 7 shows in (a) and (b), from a downstream end, examples of an annular combustors with burners 1 comprising swirlers 43 with swirl vanes 3 with a discharge flow angle α according to invention. The burners 1 are distributed equally spaced on circle around the center axis of a gas turbine and discharge the combustible mixture of fuel and gas into an annular combustor. In the example shown in FIG. 7(*a*) each burner 1 comprises one swirler 43. The vanes 3 are indicated schematically. In the example shown in FIG. 7(*b*) exemplarily a number of five swirlers 43 are arranged in a circular pattern in each burner 1.

The burners of FIGS. 7(*a*) and (*b*) can also be used in combination with a plurality of can combustors instead of in one annular combustor.

The invention claimed is:

1. An axial swirler for premixing of oxidizer and fuel in gas turbines, the axial swirler comprising:

a series of swirl vanes with a streamline cross-section, each swirl vane having a leading edge, a trailing edge, and a suction side and a pressure side extending each between said leading and trailing edges, the swirl vanes being arranged around a swirler axis, wherein said leading edges extend radially outwardly from said axis, wherein flow slots are formed between the suction side of each swirl vane and the pressure side of its circumferentially adjacent swirl vane, wherein at least one swirl vane has a discharge flow angle (α) between a tangent to its camber line at its trailing edge and the swirler axis that is monotonically increasing with increasing radial distance (R) from the swirler axis, and wherein the trailing edge of each of the swirl vanes is rotated with respect to the leading edge; and wherein a discharge flow angle ($\alpha$) on said radial distance (R) is given by a function:

$$\tan[\alpha(R)]=K\cdot R^{\beta}+H,$$

wherein $\beta$ is ranging from 1 to 10, and K and H are constants chosen such that the discharge flow angle ($\alpha(R_{min})$) at a minimum radial distance ($R_{min}$) is from 0 degrees to 20 degrees and the discharge flow angle ($\alpha(R_{max})$) at a maximum radial distance ($R_{max}$) is from 30 degrees to 50 degrees.

2. The axial swirler according to claim 1, wherein the leading edge of each of the swirl vanes is an essentially straight edge extending in a radial direction and/or the camber line of the swirl vane is curved to form a C-shape or an S-shape.

3. The axial swirler according to claim 1, wherein the trailing edge of each of the swirl vanes is rotated with respect to the leading edge, such that the trailing edge extends with increasing radial distance (R) increasingly in the direction in that the pressure side of the swirl vane faces.

4. The axial swirler according to claim 1, wherein the leading edge and/or the trailing edge of each of the swirl vanes extend radially outwardly from the swirler axis in a plane perpendicular to the swirler axis.

5. The axial swirler according to claim 1, wherein all the vanes of the series of swirl vanes are identically formed and/or in that the swirl vanes are arranged around the swirler axis in a circle.

6. A burner for a combustion chamber of a gas turbine comprising:

an axial swirler comprising:

a series of swirl vanes with a streamline cross-section, each swirl vane having a leading edge, a trailing edge, and a suction side and a pressure side extending each between said leading and trailing edges, the swirl vanes being arranged around a swirler axis, wherein said leading edges extend radially outwardly from said axis, wherein flow slots are formed between the suction side of each swirl vane and the pressure side of its circumferentially adjacent swirl vane, wherein at least one swirl vane has a discharge flow angle ($\alpha$) between a tangent to its camber line at its trailing edge and the swirler axis that is monotonically increasing with increasing radial distance (R) from the swirler axis, and wherein the trailing edge of each of the swirl vanes is rotated with respect to the leading edge; and wherein a discharge flow angle ($\alpha$) on said radial distance (R) is given by a function:

$$\tan[\alpha(R)]=K\cdot R^{\beta}+H,$$

wherein $\beta$ is ranging from 1 to 10, and K and H are constants chosen such that the discharge flow angle ($\alpha(R_{min})$) at a minimum radial distance ($R_{min}$) is from 0 degrees to 20 degrees and the discharge flow angle ($\alpha(R_{max})$) at a maximum radial distance ($R_{max}$) is from 30 degrees to 50 degrees; and wherein at least one of the swirl vanes is configured as an injection device with at least one fuel nozzle for introducing at least one fuel into the burner.

7. The burner according to claim 6, wherein fuel is injected on the suction side and/or the pressure side of at least one swirl vane.

8. The burner according to claim 6, wherein each flow slot has a gas entrance region that extends downstream from the leading edges and a gas discharge region that extends upstream from the trailing edges of its defining swirl vanes, wherein the fuel is injected into the flow slot in the gas entrance region, in the upstream third of the swirl vane and/or in a cross-flow injection.

9. The burner according to claim 6, wherein the fuel is injected by a series of fuel nozzles being preferably arranged one adjacent another in a radial direction.

10. The burner according to claim 6, wherein cooling air is introduced through the axial swirler so as to avoid flashback, wherein at least one swirl vane is provided with cooling elements, wherein the cooling elements are given by internal circulation of cooling medium along sidewalls of the swirl vane and/or by film cooling holes, located near the trailing edge, and wherein the cooling elements are fed with air from a carrier gas feed also used for the fuel injection.

11. A method for operating a burner for a combustion chamber of a gas turbine, the burner comprising an axial swirler, the axial swirler comprises a series of swirl vanes with a streamline cross-section, each swirl vane having a leading edge, a trailing edge, and a suction side and a pressure side extending each between said leading and trailing edges, the swirl vanes being arranged around a swirler axis, wherein said leading edges extend radially outwardly from said axis, wherein flow slots are formed between the suction side of each swirl vane and the pressure side of its circumferentially adjacent swirl vane, wherein at least one swirl vane has a discharge flow angle ($\alpha$) between a tangent to its camber line at its trailing edge and the swirler axis that is monotonically increasing with increasing radial distance (R) from the swirler axis, and wherein the trailing edge of each of the swirl vanes is rotated with respect to the leading edge; and wherein a discharge flow angle ($\alpha$) on said radial distance (R) is given by a function:

$$\tan[\alpha(R)]=K\cdot R^{\beta}+H,$$

wherein $\beta$ is ranging from 1 to 10, and K and H are constants chosen such that the discharge flow angle ($\alpha(R_{min})$) at a minimum radial distance ($R_{min}$) is from 0 degrees to 20 degrees and the discharge flow angle ($\alpha(R_{max})$) at a maximum radial distance ($R_{max}$) is from 30 degrees to 50 degrees, the method comprising:

introducing air through the axial swirler and determining a number of fuel nozzles through which fuel is injected as a function of a total injected fuel flow; and injecting fuel into the number of the fuel nozzles determined as the function of the total injected fuel flow.

12. The method according to claim 11, comprising:

staging the fuel injection below a threshold fuel flow such that the fuel is injected only on the suction side or the pressure side and/or only through every second or third fuel nozzle of a swirl vane and/or that fuel is only injected through the fuel nozzles of every second or third swirl vane of the burner.

13. The method according to claim 11, wherein the fuel is a highly reactive fuel.

14. The axial swirler according to claim 1, wherein the axial swirler is in an annular combustor, can combustors, or a single or reheat engine.

15. The axial swirler according to claim 1, wherein $\beta$ is from 3 to 8.

16. The axial swirler according to claim 1 wherein $\beta$ is 7.

17. The burner according to claim 6, wherein the fuel nozzles are circular.

18. The burner according to claim 6, wherein the fuel nozzles are elongated slot nozzles extending essentially parallel to the leading edge of the swirl vane.

19. The burner according to claim 6, wherein the fuel nozzles comprise a first nozzle for injection of liquid fuel, and/or a second nozzle for injection of a gaseous fuel and a third nozzle for injection of carrier air, which encloses the first nozzle and/or the second nozzle.

20. The method according to claim 13, wherein the highly reactive fuel consists of natural gas fuels, hydrogen rich fuels, and hydrogen fuel.

* * * * *